United States Patent [19]

Phillips

[11] 4,373,874

[45] Feb. 15, 1983

[54] FLUID ACTUATED PUMP SYSTEM

[76] Inventor: Albert Phillips, 465 Kiwanis Ave., Morgantown, W. Va. 26505

[21] Appl. No.: 280,333

[22] Filed: Jul. 6, 1981

Related U.S. Application Data

[63] Continuation of Ser. No. 62,247, Jul. 30, 1979, abandoned.

[51] Int. Cl.[3] ..... F04B 17/00

[52] U.S. Cl. ..... 417/397; 91/40; 91/449

[58] Field of Search ..... 417/397, 404, 299; 91/40, 461, 449

[56] References Cited

U.S. PATENT DOCUMENTS

| | | | |
|---|---|---|---|
| 1,743,090 | 1/1930 | Bayles | 91/461 X |
| 1,971,773 | 8/1934 | De Mooy | 91/40 |
| 2,402,300 | 6/1946 | Shimer | 91/39 X |
| 2,592,940 | 4/1952 | Monoyer | 417/397 X |
| 2,657,636 | 11/1953 | Schmidt | 91/40 X |
| 2,672,847 | 3/1954 | Bergman | 91/40 |
| 2,828,693 | 4/1958 | Davis et al. | 91/40 X |
| 2,917,028 | 12/1959 | Schonherr | 91/40 X |
| 3,022,738 | 2/1962 | Krute | 91/39 X |
| 3,088,283 | 5/1963 | Furia et al. | 91/461 X |
| 3,157,996 | 11/1964 | Budzich | 91/40 X |
| 3,980,002 | 9/1976 | Jarman et al. | 91/461 |

*Primary Examiner*—Leonard E. Smith

*Attorney, Agent, or Firm*—Stanley J. Price, Jr.; John M. Adams

[57] ABSTRACT

A pump system includes a source of fluid under pressure conveyed into a fluid chamber containing meshing gears which are rotated by the pressurized fluid to, in turn, transmit rotation to a unitary valve member positioned in a housing. Rotation of the gears also displaces fluid at a preselected flow rate through an inlet port of the housing and into a first inlet port of the rotary valve member. During the first one half cycle of rotation of the rotary valve member, fluid is conveyed through a first set of aligned outlet ports of the valve member and the valve housing to a water pump for displacing a water piston. The water piston is displaced to convey water through a first conduit. During the second one half cycle of rotation of the rotary valve member, fluid is conveyed through a second set of aligned outlet ports of the valve member and the valve housing to displace the water piston in an opposite direction to convey water through a second conduit. By continuously rotating the unitary valve member, fluid under pressure is alternately supplied to inlet ports of the water pump to reciprocate the water piston. For the first and second conduits having nozzle end portions, this arrangement generates a continuous spray which is adaptable in underground mining operations to suppress the circulation of dust in the mine atmosphere by directing the water spray upon the mine face as the mine material is being dislodged.

6 Claims, 9 Drawing Figures

FLUID ACTUATED PUMP SYSTEM

CROSS REFERENCE TO RELATED APPLICATION

This application is a continuation of copending application Ser. No. 062,247 filed on July 30, 1979, now abandoned entitled "Fluid Actuated Pump Sytem" by Albert Phillips.

BACKGROUND OF THE INVENTION

1. Field of the Invention

This invention relates to a fluid actuated pump system and more particularly to a rotary control valve for controlling the flow of fluid under pressure alternately to opposite faces of a piston to generate reciprocating movement of the piston.

2. Description of the Prior Art

Hydraulically-actuated pumps are well known in the art and generally include two types, the double acting piston type and the single acting plunger type. The double acting piston type includes a piston positioned for reciprocal movement in a cylinder. As the piston moves in one direction, fluid is discharged from one end of the cylinder while fluid enters the opposite end of the cylinder. Then when the piston moves in the opposite direction, the fluid is discharged from the opposite end of the piston while fluid enters the other end of the cylinder. With a single-acting plunger pump, however, fluid is moved or delivered on the forward stroke only.

U.S. Pat. No. 3,022,738 discloses a pump system for supplying and controlling hydraulic fluid under pressure to hydraulic motors coupled to pistons or plungers in a pump mechanism. The velocity of the fluid being pumped or discharged by the pistons is controlled at a constant velocity in order to eliminate pressure surges. The pump system utilizes a hydraulic control valve which includes a rotating cylinder having a plurality ports through which fluid is displaced in various rotational positions of the rotating cylinder. The hydraulic control valve receives a constant volume of fluid and is operable to meter the hydraulic fluid to hydraulic cylinders which control the acceleration and deceleration of hydraulic pistons that drive a pump for pumping fluid.

U.S. Pat. Nos. 3,547,206 and 3,654,961 disclose in a rotary percussion drill a multivalve control device that includes a plurality of individual pressure and vent valves connected in a stacked arrangement. The pressure and vent valves alternately supply fluid under pressure to opposite sides of a reciprocating piston within a cylinder. A timing device is drivingly connected to shafts of the valve members of the pressure and vent valves. The timing device is operable to open and close the pressure and vent ports to supply the pressurized fluid alternately to the opposite sides of the piston.

While it has been suggested by the prior art system to provide control valves for metering the flow of pressurized fluid to a double acting positive displacement pump or to opposite sides of a reciprocating piston within a cylinder, the prior art devices are unduly complex requiring many components that are not suitable for mounting in compact arrangements. This is of particular importance in underground mining operations where the work area is extremely limited and the operating machinery must be compactly designed for efficient operation.

Thus there is need in underground mining operations for a fluid actuated pump system capable of efficient operation on a mining machine or any other suitable piece of equipment in the mine for generating a water spray to suppress the circulation of dust particles in the working atmosphere and particularly at the mine face when the mine material is being dislodged.

SUMMARY OF THE INVENTION

In accordance with the present invention there is provided a fluid actuated pump system that includes a pump housing having an internal chamber. The chamber has a first end portion and a second end portion. An inlet and outlet extend through the housing into the chamber at the first and second end portions respectively. A valve device is positioned in the inlets and outlets for controlling the flow of fluid into and out of the chamber at each end portion thereof. A piston is positioned in the chamber for reciprocal movement between the chamber first and second end portions. The piston includes a first end portion and a second end portion positioned in spaced relation with the chamber first and second end portions respectively. A control valve includes a rotatable unitary valve member for conveying fluid under pressure in a first direction during a first half cycle of rotation of the valve member and in a second direction during a second half cycle of rotation of the valve member and thereby alternately supply fluid under pressure through the chamber inlets to reciprocate the piston in the chamber to alternately displace fluid from the chamber end portions and through the chamber outlets. A fluid actuated mechanism rotates the unitary valve member at a preselected rate corresponding to a preselected rate of reciprocation of the piston.

Further, in accordance with the present invention there is provided a control valve that includes a unitary valve housing having a bore extending therethrough. A plurality of fluid inlet and outlet ports extend through the valve housing and communicate with the bore. A rotatable unitary valve member is positioned in the bore. A bearing assembly rotatably supports the unitary valve member in the bore. The unitary valve member has a plurality of inlet ports and a plurality of outlet ports. A plurality of internal passages in the unitary valve member connect in pairs the inlet ports with the outlet ports. A drive mechanism connected to the unitary valve member rotates the unitary valve member at a preselected rotational speed. The unitary valve member is arranged upon each revolution thereof to rotate between a first valve position and a second valve position. A first set of the valve member inlet and outlet ports in the first valve position is positioned in communication with a first set of the valve housing inlet and outlet ports for directing fluid through the unitary valve member and the valve housing in a first flow pattern. A second set of the valve member inlet and outlet ports in the second valve position is positioned in communication with a second set of the valve housing inlet and outlet ports for directing fluid through the unitary valve member and the valve housing in a second flow pattern.

In a preferred embodiment of the present invention hydraulic fluid from a source is pumped through a pilot valve to an inlet of the fluid actuated mechanism which includes a pair of meshing gears positioned in a fluid chamber. The fluid entering the chamber rotates the gears thereby displacing the fluid through an outlet to unitary valve member.

The unitary valve member is drivingly connected to one of the meshing gears in the fluid chamber so that the unitary valve member rotates as the meshing gears rotate. During the first half revolution of the valve member the fluid displaced by the rotating meshing gears is directed by the unitary valve member upon an annular surface of the piston in the pump housing. Thus the piston is moved in the first direction to pump water from the housing chamber first end portion while water is admitted into the housing chamber second end portion. The water is conveyed from the pump housing through a first water conduit and is sprayed from the nozzle end portion thereof.

Accordingly during the second half revolution of the valve member, fluid under pressure is conveyed to an opposite annular surface of the piston in the pump housing chamber to advance the piston in a second direction opposite to the first direction for pumping water from the housing chamber second end portion. The water is conveyed through a second water conduit and is sprayed from the nozzle end portion thereof.

With this arrangement a continuous water spray is generated by alternately conveying fluid under pressure to opposite surfaces of the piston upon each revolution of the unitary valve member. The pump system of the present invention is particularly adaptable for use in underground mining operations to spray the mine face as mineral material is being dislodged. In this application the pump system is mounted on the mining machine. Spraying the mine face substantially suppresses circulation of particulate matter in the mine atmosphere as the mineral material is being dislodged.

Accordingly, the principal object of the present invention is to provide a fluid actuated system that includes a unitary valve member for alternately conveying fluid under pressure to opposite surfaces of a piston to reciprocate the piston, for example to alternately pump fluid at a preselected flow rate from opposite ends of the piston or to impart percussive forces upon a rotating drill rod.

A further object of the present invention is to provide a unitary rotary valve member operable upon each revolution of the valve member to alternately direct fluid in first and second directions to generate reciprocating movement of a piston.

Another object of the present invention is to provide a fluid actuated pump system operable to reciprocate a water piston for alternately discharging water under pressure through conduits to generate a continuous spray of water upon a mine face to suppress the circulation of particulate matter in a mine as the mine material is being dislodged.

These and other objects of the present invention will be more completely disclosed and described in the following specification, the accompanied drawings, and the appended claims.

DESCRIPTION OF THE PREFERRED EMBODIMENT

Figure 1:
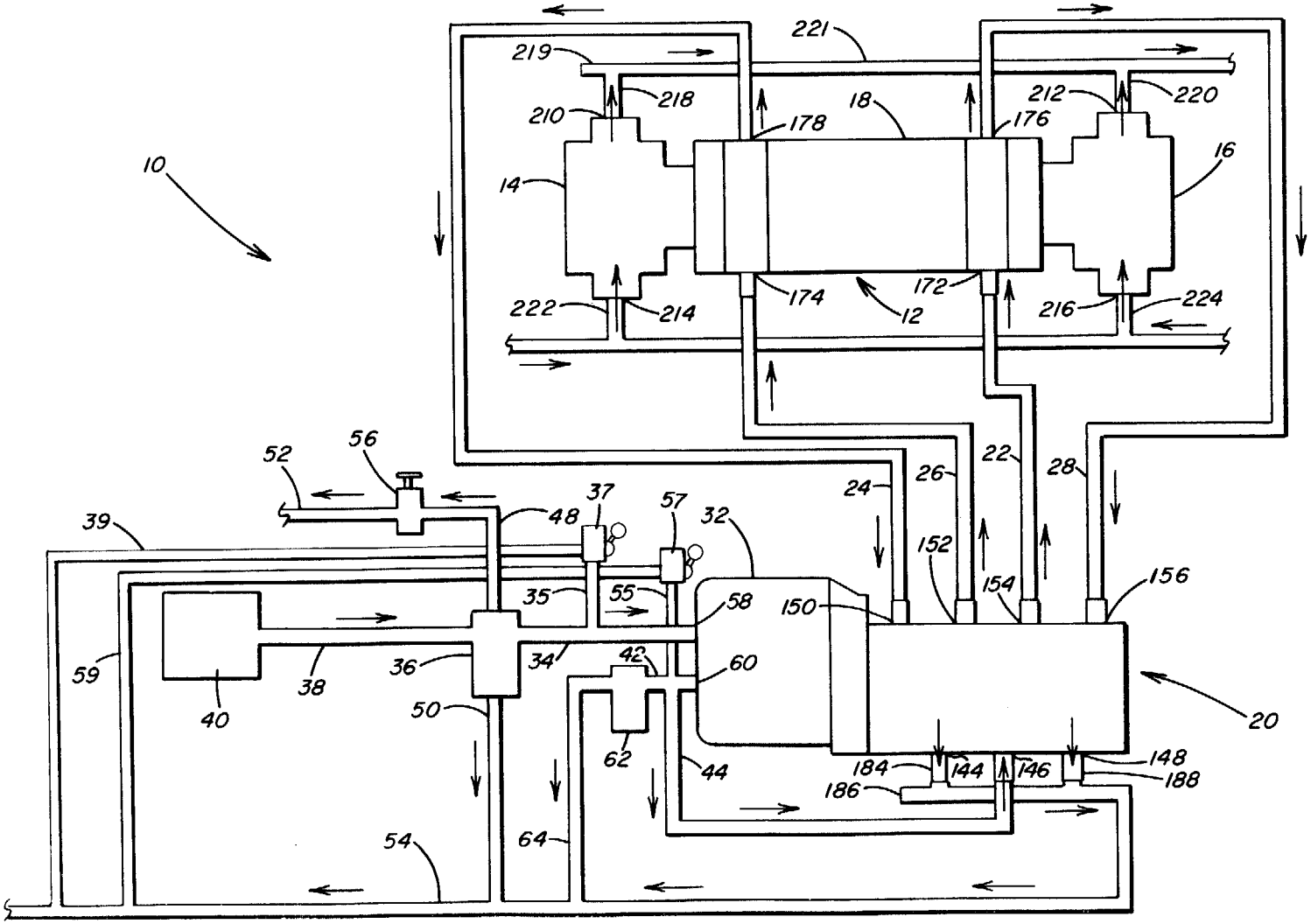
FIG. 1 is a schematic view of the pump system of the present invention, illustrating a control valve for supplying fluid under pressure alternately to opposite ends of a piston in a hydraulically actuated pump to reciprocate the piston and thereby displace water from the pump.

Referring to the drawings and particularly to FIG. 1, there is illustrated a hydraulic system generally designated by the numeral 10 that includes in a continuous hydraulic circuit a reciprocating pump 12 for alternately pumping fluid under pressure from opposite ends 14 and 16 of a pump housing 18 by operation of a control valve 20. The control valve 20 is connected to the pump 12 by conduits 22–28 to thereby direct pressurized fluid from the pump 12 in selected directions and thereby control the direction from which fluid is conveyed from the pump 12. The control valve 20 includes a rotary valve member 30, illustrated in greater detail in FIGS. 3 and 4, rotatable at a preselected rate by a timing device 32 which is drivingly connected to the rotary valve member 30.

The timing device 32 is actuated by fluid under pressure received from a conduit 34 which is connected by a conventionally known pressure operated pilot valve 36 of a type disclosed in U.S. Pat. No. 4,113,076 and a conduit 38 to a fluid pump 40. The pump 40 is conventionally driven by a motor (now shown) and supplies hydraulic fluid under pressure from a source to conduit 38. The timing device 32 directs pressurized fluid through conduits 42 and 44 to an inlet of the control valve 20. The control valve 20 is, in turn, operable to selectively supply pressurized fluid from outlets to the pump 12 to reciprocate the pump 12 at a preselected rate. Conduit 34 is connected by conduit 35 to a conventional operator actuated flow control valve 37. Flow control valve 37 is connected by conduit 39 to the fluid reservoir of the system 10.

In a preferred embodiment of the present invention, the hydraulic system 10 is operable to actuate a water spray unit associated with a continuous mining machine or a rotary percussion drill, both adapted for use in underground mining operations. By operation of the hydraulic system 10 with a water spray unit, water is sprayed at a preselected pressure and volumetric rate upon the mine face as the mining machine dislodges solid material from the mine face. In this manner the coal dust discharged into the mine atmosphere as a result of the mining operation is substantially suppressed by water sprayed upon the face as the mine material is dislodged. This substantially reduces the health hazards presented by coal dust circulating in the mine atmosphere to the mine personnel and particularly to those working at the mining face where the concentration of dust in the mine atmosphere is particularly high.

To facilitate this method of dust suppression in underground mining operations, the pump system 10 is adaptable for mounting on the mining machine. In this arrangement the pump 40 is continually operated by a motor provided on the mining machine. However, due to the fact that the pump system 10 is not required to be constantly in operation, such as when the mining machine is being moved into and out of position relative to the mine face, fluid is directed through pilot valve 36 and conduit 34 to the timing device 32 only when needed. Thus when the pump system 10 is not in operation, fluid is normally conveyed by the pilot valve 36 through conduits 48 and 50 to conduits 52 and 54 to a fluid reservoir (not shown) which serves as a source of fluid. It should be understood that the hydraulic system is pressurized and continuous, and the pump 40 receives fluid from the fluid reservoir which is connected to conduits 52 and 54.

Conduit 48 is connected to conduit 52 by a valve 56, such as a needle valve, which is located in the operator's compartment of the mining machine from which the operation of the pump system 10 is controlled. It will be apparent to those skilled in the art that the pump system 10 is applicable to any pump operation utilizing a reciprocating pump piston. Further, the control valve 20 is operable in a number of applications to generate reciprocating movement, particularly of a piston, as will be explained hereinafter in greater detail.

Figure 6:
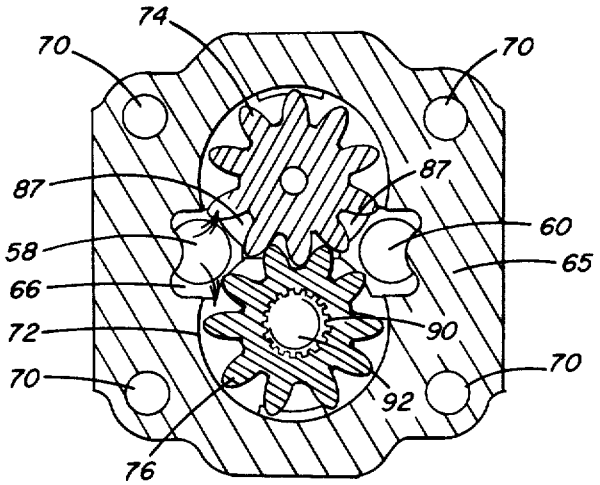
FIG. 6 is a view in section taken along line VI—VI of FIG. 3, illustrating the timing gears for rotating the rotary valve at a preselected rate.

The timing device 32 has an inlet 58, illustrated schematically in FIG. 1 and in greater detail in FIG. 6, connected to conduit 34 from the pilot valve 36 and an outlet 60 connected to conduit 42. Conduit 42 is connected to a pressure relief valve 62 and by conduit 55 to a conventional operator actuated flow control valve 57. Flow control valve 57 is connected by conduit 59 to the fluid reservoir of the system 10. The pressure relief valve 62 is downstream of the connection of conduit 42 to conduit 44 and is, in turn, connected to a conduit 64. Conduit 64 connects the conduit 54 as do conduits 39 and 59 for returning fluid to the reservoir.

The flow control valve 37 is operable to adjust the volume of fluid entering the timing device 32 to control the rate of pumping of pump 12. The flow control valve 57 and the pressure relief valve 62 are operable to adjust the volume of fluid conveyed from the timing device 32 to the rotary control valve 20 and, in turn, to control the volume of water pumped by the reciprocating pump 12, as will be explained later in greater detail.

The valve 62 in one embodiment is a conventional poppet-type discharge valve including a spring acting against a valve element that controls fluid flow through valve 62 from conduit 42 to conduit 64. By adjusting a set screw which abuts the spring, the tension on the spring is controlled to, in turn, control the force applied to the valve member and thereby control the position of the valve element with respect to its valve seat, as determined by the force of the fluid flowing through conduit 52 and applied to the opposite side of the valve element. Thus the valve 62 is adjustable, for example, by turning the set screw to a selected position to permit a selected volume of fluid pass through the valve 62 and into conduit 64. This reduces the volume of fluid flowing from the timing device 32 to the rotary valve member 30. Normally, valve 62 is set on the valve 30 for a preselected volume. Valve 57 is positioned at the machine operator's station and provides a further reduction, upon actuation, in the volume of flow to valve 20. In this manner the volume of water displaced by the pump 12 is adjustable.

Normally, the pump system 10 is not in operation on the mining machine because the needle valve 56 is maintained in an open position at the machine operator's station. Fluid is thus diverted by the pilot valve 36 from conduit 38 through conduits 48, 52 and 50, 54 to the fluid reservoir. Operation of the pump system 10 is commenced, however, by the machine operator closing the needle valve 56 thereby blocking flow to conduit 52 and building up the fluid pressure in conduit 48. When the fluid pressure in conduit 48 reaches a preselected magnitude, the pilot valve 36 is actuated to direct fluid flow through conduit 34 to the timing device 32 and to interrupt fluid flow through conduits 48 and 50 to the reservoir. Thus pump 40 supplies fluid at a preselected volumetric rate, for example 14 gal./min., into the inlet 58 of timing device 32. The flow control valve 37 is also positioned at the machine operator's station. Upon actuation by the operator, the valve 37 is opened to a preselected position to permit a portion of fluid flow from conduit 34 to be diverted to the fluid reservoir. This reduces the volume of fluid entering the timing device 32 to thereby control the rate of rotation of the rotary valve member 30 and accordingly the rate of reciprocation of pump 12.

Figure 3:
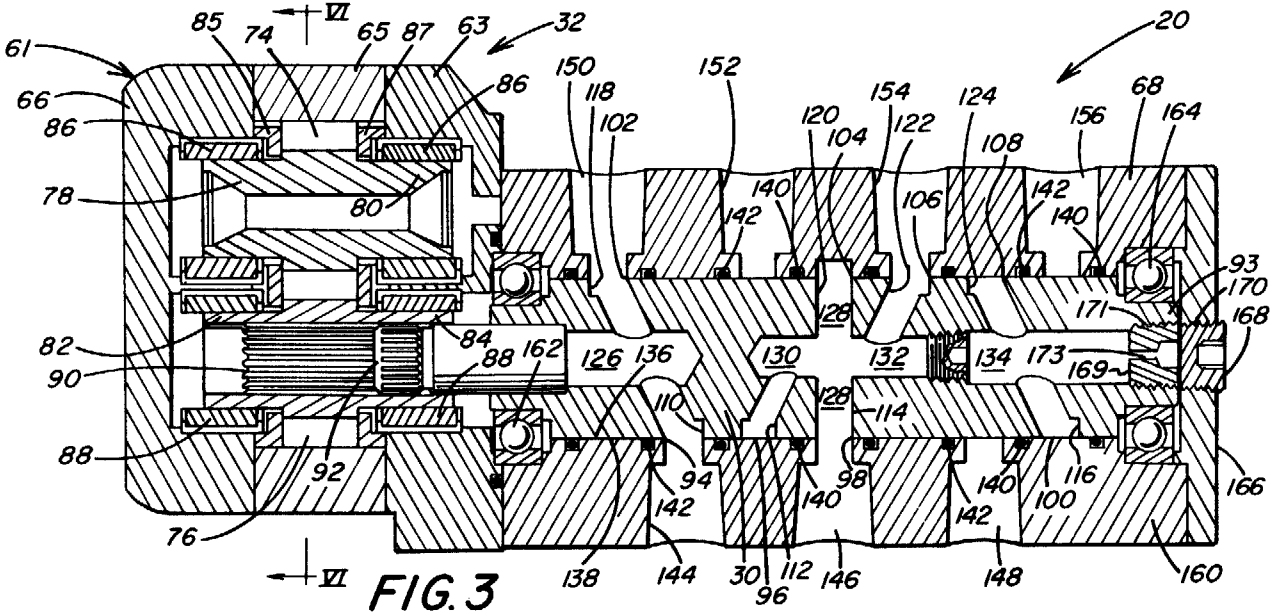
FIG. 3 is a view in section of the control valve, illustrating the rotary valve member in a first position for directing fluid under pressure to one end of the piston in the pump.

The timing device 32, as illustrated in greater detail in FIGS. 3 and 6, includes a housing assembly generally designated by the numeral 61. The housing assembly 61 is formed by a first housing end portion 63, a housing intermediate portion 65, and a second housing end portion 66. The housing end portion 63 is conventionally bolted, in a manner not shown in FIG. 3, to a cylindrical housing 68 of control valve 20. The housing intermediate portion 65 is positioned in abutting relation with and between housing end portions 63 and 66. The abutting housing portions 63, 65 and 66 include aligned threaded bolt holes 70, as illustrated for housing intermediate portion 65 in FIG. 6, through which bolts (not shown) are adapted to threadedly extend and thereby securely connect the housing portions 63, 65 and 66.

As illustrated in FIG. 6, the housing intermediate portion 65 includes a fluid chamber 72 and a pair of meshing gears 74 and 76 are positioned in the fluid chamber 72. The inlet 58 into the timing device 32 extends through the housing end portion 66 and communicates with fluid chamber 72 on one side of the meshing gears 74 and 76. Similarly, the outlet 60 from the timing device 32 extends through the housing end portion 66 and communicates with fluid chamber 72 on the opposite side of the meshing gears 74 and 76. The gear 74 has shaft end portions 78 and 80. The gear 76 has shaft end portions 82 and 84. The shaft end portions 78, 80 and 82, 84 are rotatably supported in fluid chamber 72 by bearing assemblies 86 and 88 respectively. The bearing assemblies 86 and 88 are rotatably supported in housing end portions 63 and 66.

A pair of metal gaskets 85 and 87 is suitably secured to housing end portions 63 and 66. The gear shaft end portions 78 and 80 extend through gaskets 87 and 85, respectively, and the gear shaft end portions 82 and 84 extend through gaskets 87 and 85, respectively. With this arrangement, the gaskets 85 and 87 are positioned between the teeth of gears 74 and 76 and the housing end portions 63 and 66, respectively. Thus, the gaskets 87 and 85 seal the fluid chamber 72 to prevent fluid from passing out of the chamber 72 between the gear teeth of gears 74 and 76 and the housing end portions 63 and 66. This arrangement retains the fluid in chamber 72 in surrounding relation with the gear teeth of gears 74 and 76.

As illustrated in FIG. 6, timing gear 76 has an internally splined end portion 90 which receives in meshing relation an externally splined end portion 92 of the rotary valve member 30. Thus with this arrangement, the gears 74 and 76 are arranged upon rotation to displace in the directions indicated by the arrows fluid entering chamber 72 through the inlet 58 around the meshing gear teeth to the outlet 60. The fluid in chamber 72 flows therefrom through the outlet 60. The volume of fluid entering inlet 58 and exiting outlet 60 of the chamber 72 determines the rate of rotation of the gears 74 and 76, and thus the rate of rotation of the rotary valve member 30 and the rate of reciprocation of the pump 12. The volume of fluid flow to the timing device 32 is adjustable by operation of valve 37 at the operator's station. When the valve 37 is closed, the gears 74 and 76 rotate at a maximum rate. As the valve 37 is opened, the volume of flow to device 32 decreases, as well as, the rate of gear rotation. A more complete description of the timing device 32 is set forth in U.S. Pat. Nos. 3,547,206 and 3,654,961 which are incorporated herein by reference.

Figure 4:
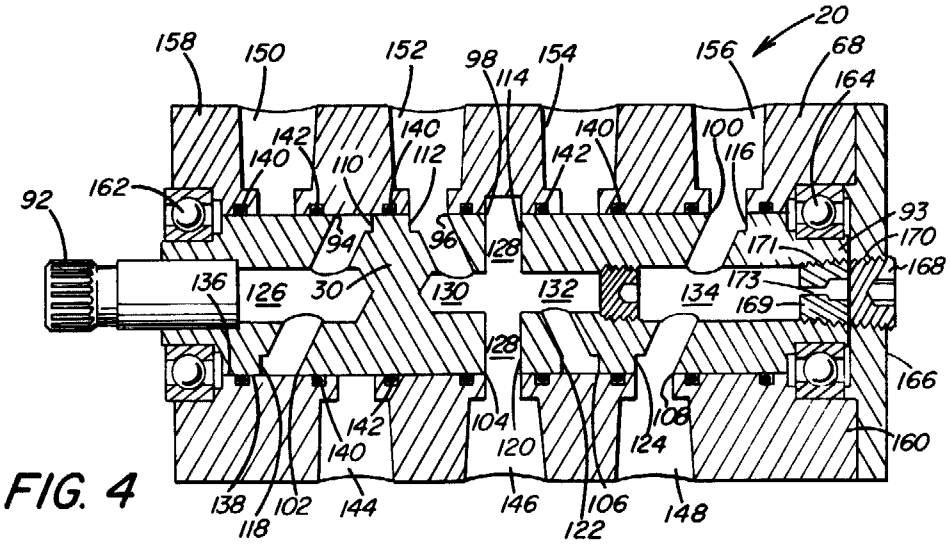
FIG. 4 is a fragmentary sectional view of the control valve, illustrating the rotary valve member in a second position for directing fluid under pressure to the opposite end of the piston in the pump.

Fluid exits the timing device chamber 72 at a preselected rate through outlet 60 and flows through conduits 42 and 44 to the rotary valve member 30. The rotary valve member 30, as illustrated in its two positions of operation shown in FIGS. 3 and 4, is a unitary rotary member 30 having the splined end portion 92 and a second, opposite end portion 93. The unitary rotary valve member 30 preferably has a cylindrical body portion with a plurality of ports or openings 94, 96, 98, 100, 102, 104, 106 and 108 communicating with a plurality of peripheral recess portions 110, 112, 114, 116, 118, 120, 122, 124 respectively positioned on the external surface of the rotary valve member body portion.

If should be noted that the peripheral recesses 114 and 120 form an endless circumferential recess around the rotary valve member 30. The other peripheral recesses 110, 112, 116, 118, 122 and 124 extend an equal length for about 180° around the circumference of the rotary valve member 30. Thus with this arrangement for the valve member 30 positioned, for example as illustrated in FIG. 3, the recesses 118, 122, and 124 are longitudinally spaced apart along the length of the valve member 30 and positioned on the upper half of the peripheral surface of the valve member 30. On the other hand, the recesses 110, 112 and 116 also being longitudinally spaced apart along the length of the valve member 30 are positioned on the lower half of the peripheral surface of the valve member 30.

The valve member 30 includes a plurality of internal passages which connect certain valve member ports. Internal passage 126 communicates with the valve ports 94 and 102 and peripheral recess portions 110 and 118. A central internal passage 128 communicates with the valve ports 98 and 104 and the continuous peripheral recess around the valve member 30. Internal passage 130 extends from port 96 and recess 112 into communication with passage 128 in the center of the valve member. Similarly, internal passage 132 extends from port 106 and recess 122 into communication with central passage 128. Thus passages 130 and 132 are in fluid communication with one another. Internal passage 134 communicates with the valve ports 100 and 108 and peripheral recess portions 116 and 124.

Further as illustrated in FIG. 3 the rotary valve member 30 is rotatably supported by the cylindrical housing 68 which is bolted, as above discussed, to the timing device housing 66. The housing 68 includes an internal axial passageway 136 forming an internal cylindrical surface 138. A plurality of circumferential axially spaced grooves 140 are provided in the internal surface 138 and are adapted to receive O-ring seal members 142.

A plurality of ports 144, 146, 148, 150, 152, 154, and 156 extend through the housing 68 into the passageway 136 and are arranged to communicate with selective ports of the rotary valve member 30. The O-rings seal members 142 are positioned in the grooves 140 which are positioned on opposite sides of the housing ports 144–156. The O-ring seal members 142 thus provide a fluid tight seal between the valve housing internal surface 138 and the external surface of the valve member 30 on opposite sides of the housing ports 144–156 to prevent leakage of fluid from the ports 144–156.

As illustrated in FIG. 3, the housing 68 has an end portion 158 and an opposite end portion 160. The housing end portion 158 carries a roller bearing assembly 162 in the passageway 136 in surrounding relation with the valve member 30 to rotatably support the splined end portion 92 of valve member 30. The valve member end portion 93 carries a roller bearing assembly 164. The housing end portion 160 surrounds the roller bearing assembly 164. This arrangement permits rotation of the valve member end portion 93 relative to the housing end portion 160. A cap 166 is suitably bolted to the housing end portion 160. The cap 166 has an internally threaded bore 170 extending centrally through it. Aligned with threaded bore 170 is a threaded bore 171 of valve member 30. Threaded bore 171 communicates with passage 134. A plug 169 is positioned in bore 171, and a passage 173 extends through the plug 169 into passage 134. The bore 170 through cap 166 is sealed by a plug 168. Thus plug 168 seals passages 134 and 173 at housing end portion 160 and by removing plug 168 passages 134 and 173 are vented.

Referring to FIG. 1 conduit 44 is connected to valve housing port 146 to supply fluid under pressure thereto from the timing device 32. Fluid is conveyed by rotation of the valve member 30 to either housing port 152 or 154. During the first one half revolution of the valve member 30, for example as illustrated in FIG. 3, fluid is conveyed through passages 128 and 132 to valve member port 106 which registers with the housing port 154. Accordingly, during the second one half revolution of the valve member 30, as illustrated in FIG. 4, fluid is conveyed through passages 128 and 130 to valve member port 96 registering with the housing port 152. Port 154 is connected by conduit 22 to a first fluid inlet port 172 of pump housing 18, and port 152 is connected by conduit 26 to a second fluid inlet port 174 of pump housing 18.

The pump housing 18 is also provided with a pair of fluid outlets or return ports 176 and 178 which are connected by conduits 28 and 24 respectively to the housing ports 156 and 150. In the position of the rotary valve member 30 shown in FIG. 3, fluid returned from the pump 12 through conduit 24 to housing port 150 is conveyed to the valve member port 102 and the recess portion 118 and through the valve member internal passage 126 to the valve member port 94 and recess portion 110 and therefrom through the housing port 144. A conduit 184 is connected to housing port 144 and conduit 54 so that the fluid exhausted from the pump fluid outlet 178 is returned to the tank or reservoir (not shown) connected to conduit 54. Conduit 54 is closed at end portion 186 thereby requiring fluid in conduit 54 to be conveyed to the fluid reservoir. It should be understood that conduit 54 to the fluid reservoir (not shown) includes conventional valve means for maintaining conduit 54 pressurized.

In the position of the valve member 30 as shown in FIG. 4, fluid returned from the pump 12 through conduit 28 to housing port 156 enters the valve member internal passage 134 through valve member port 100 and recess portion 116. In this position of the valve member 30, valve member port 108 and the recess portion 124 register with the housing outlet 148. Housing outlet 148 is, in turn, connected to conduit 188 which is connected to the conduit 54. Thus fluid exhausted from the pump fluid outlet 176 is returned through the valve member 30 and conduit 188 to conduit 54 and the fluid reservoir.

Figure 2:
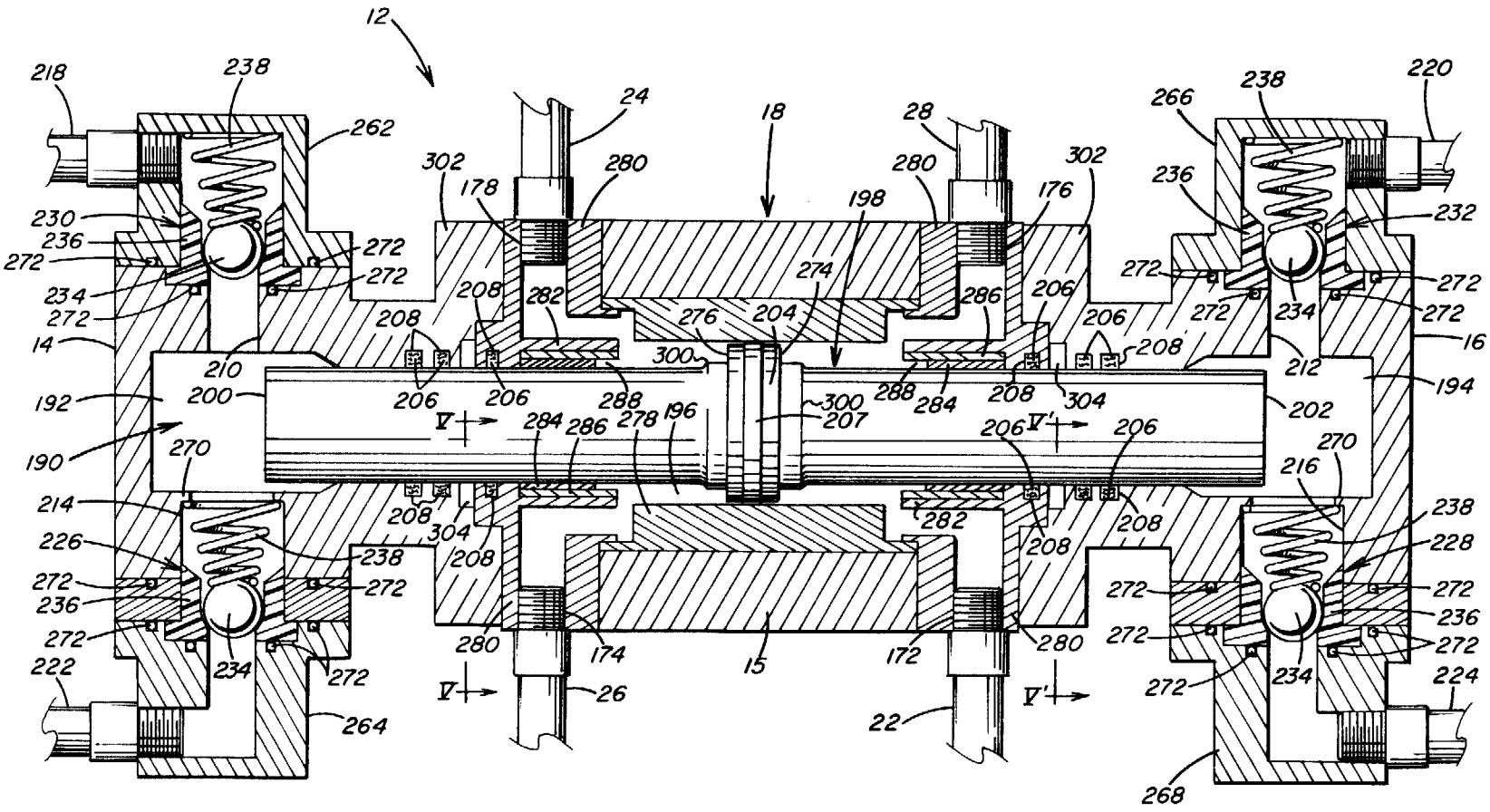
FIG. 2 is a view in section of the hydraulically actuated pump taken along line II—II of FIG. 1A, illustrating the piston in an intermediate position between the two end positions in the pump housing.

Now referring to FIG. 2, there is illustrated the reciprocating pump 12 which includes the housing generally designated by the numeral 18, and having end portions 14 and 16 suitably connected to an intermediate portion 15. The housing 18 includes an internal chamber generally designated by 190 and having enlarged chamber end portions 192 and 194 and an intermediate chamber portion 196. A piston generally designated by numeral 198 having end portions 200 and 202 and an enlarged diameter intermediate portion 204 is supported by the housing 18 for back and forth reciprocal movement within chamber 190. Annular sealing members 206 are retained in circular grooves 208 in housing end portions 14 and 16 surrounding the chamber 190. The sealing members 206 sealingly abut the piston 198 to provide a fluid tight seal separating the chamber intermediate portion 196 from the chamber end portions 192 and 194. The intermediate portion 204 includes a circumferential recess for receiving a seal ring 207 to prevent fluid leakage past portion 204. With this arrangement, chamber intermediate portion 196 is arranged to receive fluid under pressure from the control valve 20, and chamber end portions 192 and 194 to receive water from a suitable source (not shown). By generating reciprocal movement of the piston 198 in chamber 190 water under pressure is alternately pumped from the chamber end portions 192 and 194 through outlet ports 210 and 212 respectively. Accordingly, water enters the chamber end portions 192 and 194 through inlet ports 214 and 216 respectively.

Further as illustrated in FIG. 2, the outlet ports 210 and 212 of the pump housing 18 are suitably connected to conduits 218 and 220 respectively. Conduit 218 is connected by T connection 219 to conduit 221 which is connected to conduit conduit 220. Conduits 218 and 220 are adapted in accordance with the practice of the present invention in underground mining operations to extend on the mining machine from the pump 12 to a position for casting a water spray upon the mine face as mine material is being dislodged by the cutting elements of the mining machine. To facilitate the water spraying operation, the end of conduit 221 is provided with a bank of nozzles (not shown) having a preselected orifice diameter for generating a preselected water spray operable to substantially suppress the entrance of particulate mine material into the mine atmosphere. T connection 219 is adaptable for connection to another conduit to provide additional water flow from pump 12.

Figure 8:
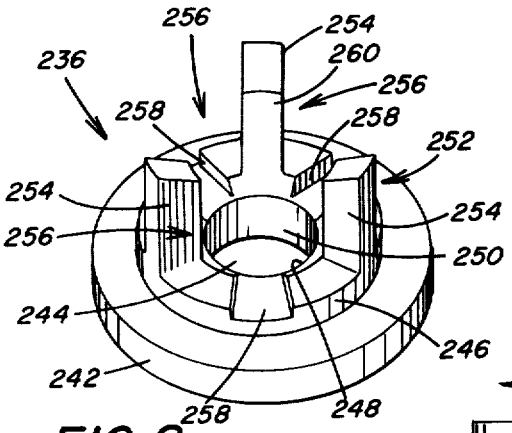
FIG. 8 is a perspective view of the support member for the ball valve shown in FIG. 7.

The pump inlet ports 214 and 216 are suitably connected to conduits 222 and 224 for conveying water to the inlet ports 214 and 216. Further in accordance with the present invention, the flow of water into the chamber end portions 192 and 194 from conduits 222 and 224 through the inlet ports 214 and 216 is controlled by the valve assemblies generally designated by the numerals 226 and 228. Similarly, the flow of water from the chamber end portions 192 and 194 through the outlet ports 210 and 212 to conduits 218 and 220 is controlled by the valve assemblies generally designated by the numerals 230 and 232. The valve assemblies 226–232 are each a ball-type valve and have a similar arrangement of elements that includes a valve closure member 234 having a spherical configuration, a valve housing 236 and a coil spring 238. FIG. 8 illustrates the configuration of the valve housing 236 for each of the valve assemblies.

As illustrated in FIG. 2, the valve assemblies 230 and 232 are normally operable to prevent flow of water out of chamber end portions 192 and 194 through the outlet ports 210 and 212 by the action of the coil springs 238 urging the closure members 234 into a closed position in the valve housings 236. Similarly, the valve assemblies 226 and 228 are normally operable to prevent flow of water into chamber end portions 192 and 194 through the inlet ports 214 and 216 by the action of the coil springs 238 urging the closure members 234 into a closed position in the valve housings 236.

Figure 7:
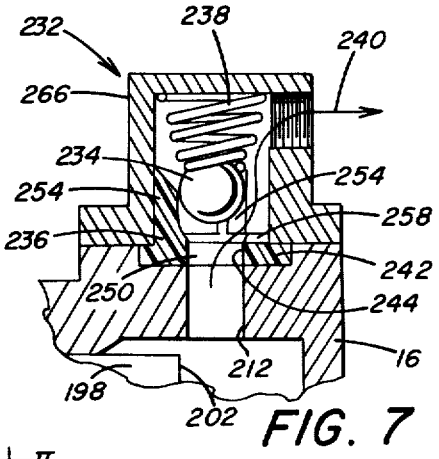
FIG. 7 is an enlarged fragmentary sectional view of one of the ball valves for the pump illustrated in FIG. 2.
Figure 1A:
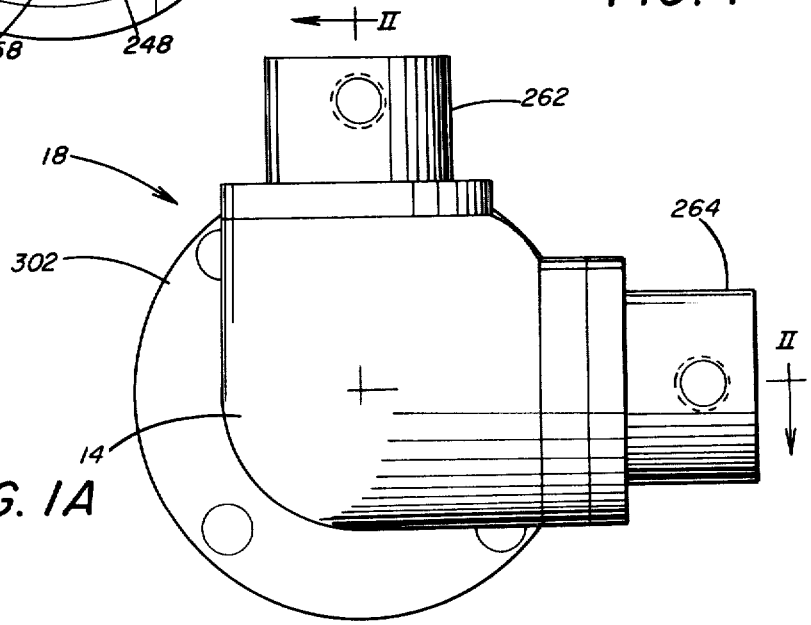
FIG. 1A is an end view of the hydraulically actuated pump.

Referring to FIGS. 2 and 7, there is illustrated operation of the valve assembly 232 to permit flow of water through the outlet port 212 and the valve assembly 232 to the conduit 220. Upon movement of the piston end portion 202, in a manner to be described later in greater detail, water in the chamber end portion 194 is displaced upwardly through outlet 212. The fluid pressure acting upon the closure member 234 against the force of spring 238 overcomes the spring force to lift the closure member 234 from a closed position in the valve housing 236, as shown in FIG. 2, to an open position in the valve housing 236, as shown in FIG. 7. In the open position, fluid is permitted to flow through the valve housing 236 and past the closure member 234, as indicated by the directional arrow 240 shown in FIG. 7. In this manner water flows to the conduit 220.

While fluid is being discharged from the chamber end portion 194, the spring 238 of valve assembly 228 maintains the closure member 234 in a closed position in the valve housing 236. Simultaneously, at the opposite end of the water piston 198, the valve assembly 230 is operable to prevent fluid from being conveyed through the outlet port 210 to the water conduit 218. However, water is being drawn into chamber end portion 192, as by suction, when the water piston 198 is displaced to the right as viewed in FIG. 2 when piston end portion 202 moves toward the chamber end portion 194. Water enters conduit 222 and urges the closure member 234 of valve assembly 226 upwardly in the valve housing 236. The coil spring 238 is compressed and water flows past the closure member 234 and through the inlet portion 214 into the chamber end portion 192. This operation is reversed when the water piston 198 is moved to the left in the chamber 190 of pump 12, as viewed in FIG. 2. Movement of piston 198 to the left discharges water from the chamber end portion 192 as water enters the chamber end portion 194.

Thus with the above described arrangement, during the first one half cycle of rotation of rotary valve member 30 to the position illustrated in FIG. 3, hydraulic fluid under pressure flows through conduit 22 from the control valve 20 into the water pump 12. Hydraulic fluid also flows through conduit 24 from the water pump 12 into the control valve 20. In this manner, the water piston 198 is moved to the left as viewed in FIG. 2 to thereby discharge water from chamber end portion 192 through pump outlet port 210 to conduit 218.

During the second one half cycle of rotation of rotary valve member 30 to the position illustrated in FIG. 4, hydraulic fluid under pressure flows through conduit 26 from the control valve 20 into the water pump 12. Hydraulic fluid also flows through conduit 28 from the water pump 12 into the control valve 20. In this manner the water piston 198 is moved to the right to thereby discharge water through pump outlet port 212 to the conduit 220.

Now referring in greater detail to the construction of the ball-type valve assemblies 226–232 and to FIGS. 2, 7 and 8, each of the valve assemblies includes the valve housing generally designated by the numeral 236 in FIG. 8. The valve housing 236 includes an annular base 242 having an axial bore 244. Concentrically formed integral with base 242 is a ring support 246 having a bore 248 coaxial with bore 244 and forming a valve seat 250. The valve seat 250 is adapted to receive the valve closure member 234.

Movement of the valve closure member 234 into and out of sealing relation with the valve seat 250 to thereby close and open the respective valve assembly is controlled by a valve guide generally designated by the numeral 252 in FIG. 8. The valve guide 252 is formed by a plurality of prongs 254 that extend upwardly from ring support 246 in surrounding axial relation with the valve seat 250. The prongs 254 are positioned around the valve seat 250 and are spaced an equal radial distance apart to maintain movement of the valve closure member 234 in an axial direction with respect to the valve seat 250 when the member 234 moves between the open and closed position of the respective valve assembly.

By spacing the prongs 254 apart, openings 256 are provided between the prongs 254. The openings 256 extend longitudinally from the ring support 246 to the end of the prongs 254. However, the openings 256 are increased in length by the provision of recesses 258 in the top surface of the ring support 246. The recesses 258 are positioned between the prongs 254 and have a preselected width which is preferably less than the distance between adjacent prongs 254. The recesses 258 extend radially outwardly from the valve seat 250 to form a passage for the flow of fluid between the prongs 254 without requiring substantial displacement of the valve closure member 234 from the valve seat 250 in order to open the respective valve assembly.

As illustrated in FIG. 7, the valve assembly 232 is in an open position. In the open position, valve closure member 234 is raised from the valve seat 250 a sufficient distance to permit fluid to pass through the bores 244 and 248, illustrated in FIG. 8, and around the valve closure member 234. Once the valve closure member 234 is moved to a position relative to the seat 250 where a gap is provided between the valve closure member 234 and the recesses 258, fluid is permitted to flow past the valve closure member 234, through the recesses 258 and between the prongs 254. This arrangement requires only a very short vertical displacement of the valve closure member 234 from the valve seat 250 in order to open the valve assembly. Thus once the valve closure member 234 is displaced above the recesses 258, fluid is free to flow between the prongs 254.

The total displacement of the valve closure member 234 from the valve seat 250 is determined by the fluid pressure acting on the member 234 against the coil spring 238 and the forces required to compress the coil spring 238 as determined by the spring constant. However, once the coil spring 238 has been compressed a sufficient amount to raise the valve closure member above the ring support 246, the respective valve assembly is opened, as illustrated in FIG. 7. Further, as illustrated in FIGS. 7 and 8, the inner surface 260 of each prong 254 is concave to facilitate axial guiding of the spherical valve closure member 234 by the prongs 254 between the open and closed positions.

As illustrated in FIG. 2, each valve assembly 226–232 is securely supported in the end portions 14 and 16 of the pump housing 18. The valve housings 236 of the valve assemblies 226 and 230 at end portion 14 are securely retained in alignment with ports 210 and 214 by flanges 262 and 264 which are suitably connected to the end portion 14. Similarly, flanges 266 and 268 support the valve housings 236 in the pump housing end portion 16. The respective flanges 262–268 are connected to conduits 218, 222, 220 and 224. Also as seen in FIG. 2, the flanges 262 and 266 for the water outlet conduits 218 and 220 support one end of coil springs 238 with the opposite end of each coil spring abutting the respective valve closure member 234.

For the valve assemblies 226 and 228 in the water inlet ports 214 and 216 of the pump 12, the respective coil springs 238 abut the valve closure member 234 at one end and an in-turned shoulder 270 in each housing end portion 14 and 16 at the opposite end. With this arrangement, the valve closure members 234 are normally maintained in a closed position on the valve seats 250 to prevent fluid, such as water, from entering the pump chamber end portions 192 and 194 from supply conduits 222 and 224. Further, as illustrated in FIG. 2, a plurality of O-ring seals 272 are supported by the pump housing end portions 14 and 16 in surrounding relation with the valve assemblies 226–232. This arrangement seals the valve assemblies 226–232 in the pump housing 18 to prevent fluid leakage around the valve assemblies.

In operation of the pump system 10, the piston 198 is reciprocated from its center or neutral position in the pump chamber 190, as illustrated in FIG. 2, left and right to displace water from the chamber end portions 192 and 194 by rotation of the rotary valve member 30. Accordingly, the rate of rotation of the valve member 30 is controllable by operation of flow control valve 37 to limit the volume of hydraulic fluid entering the timing device 32. Maximum rotational speed of valve member 30 is provided when valve 37 is closed. Opening valve 37 reduces the rotational speed. The position of valve 37 between the open and closed positions is adjustable. Thus with this arrangement, for example, with the pump 40 providing a maximum flow rate of 14 gallon per minute and the valve 37 closed, the rate of reciprocation of water piston 198 is 440 strokes per minute. By opening valve 37 to a selected position, the volume of flow to timing device 32 is reduced and the rate of piston reciprocation is reduced to 300 strokes per minute.

The provision of pressure relief valve 62 allows adjustments to be made in the length of the stroke of piston 198 to control the volume of water displaced by the piston 198. The pressure relief valve 62 is operable to be adjusted to direct a portion of the fluid flow to the reservoir and thereby reduce the volume of fluid under pressure entering the control valve 20. The additional provision of the flow control valve 57 in the operator's station permits an incremental decrease in the volume of fluid entering the control valve 20. The position of valve 62 establishes the maximum volume of fluid to valve 20. The position of valve 57 permits adjustments in the volume of flow below the maximum volume permitted by the setting of valve 62.

Upon one complete rotation of the rotary valve member 30, the water piston 198 is reciprocated to fill and empty each water pump chamber end portion 192 and 194. For dust suppression operations, this provides a continuous spray by alternately conveying water under pressure through the conduits 218 and 220. During the first one half rotation of valve member 30, the valve member 30 is in the position illustrated in FIG. 3. Hydraulic fluid enters the valve 20 through inlet port 146 and is conveyed by the valve member 30 to outlet port 154 and conduit 22. Fluid under pressure enters the pump housing inlet port 172 and acts on annular surface 274 of the piston enlarged intermediate portion 204. The piston 193 moves to the left. Similarly, fluid pressure acting on the opposite annular surface 276 of the piston intermediate portion 204, when the valve member 30 is in the position of FIG. 4, moves the piston 198 to the right.

The piston intermediate portion 204 moves within a sleeve 278 that is concentrically positioned within the chamber intermediate portion 196. The sleeve 278 is securely connected to pump housing intermediate portion 16 by flanges 280 that suitably connect as by bolts (not shown) the housing intermediate portion 16 to the housing end portions 14 and 16. The flanges 280 are provided with the ports 172–178 to which conduits 22, 26, 28 and 24 are connected respectively.

The flanges 280 are also provided with tubular sections 282 that concentrically surround the pump piston 198 in spaced relation. The tubular sections 282 support a pair of concentrically positioned sleeves 284 and 286 in surrounding and abutting relation with the piston 198. The sleeve 286 is longer than the sleeve 284 thereby providing a chamber 288 between sleeve 286 and piston 198. The piston intermediate portion 204 is also provided with shoulders 300 operable to move into the chambers 288 when the piston 198 is reciprocated left and right. Thus, when piston 198 is reciprocated to the left by fluid under pressure entering inlet port 172 and fluid exiting through outlet port 178, the left shoulder 300 moves into the chamber 288.

The fluid entrapped within the chamber 288 serves as a liquid cushion for the piston 198. The same arrangement is provided when the piston 198 is moved to the right and the right shoulder 300 moves into the chamber 288. This fluid cushion for the piston 198 is described in further detail in the above identified patents which have been incorporated herein by reference.

As the piston 198 moves to the left, water in chamber end portion 192 is displaced therefrom through outlet port 210. The force of coil spring 238 is overcome, moving the valve closure member 234 off the valve seat 250 and permitting fluid to pass through the valve assembly 230, as illustrated for the valve assembly shown in FIG. 7, to the conduit 218. The valve assembly 226 is maintained closed to prevent water from entering chamber end portion 192 during this cycle of operation of the rotary valve member 30. At the same time fluid is conveyed from chamber end portion 192, fluid is conveyed into chamber end portion 194. Suction forces generated by moving the piston 198 to the left overcome the forces of the coil spring 238 of valve assembly 228 acting on closure member 234, permitting member 234 to rise off the valve seat 250. Water from a suitable source (not shown) then passes from conduit 224 through the valve assembly 228 and inlet 216 into the chamber end portion 194. Valve assembly 232 remains closed during this stage of operation of pump 12 to prevent escape of fluid into conduit 220.

Hydraulic fluid displaced by movement of the piston 198 to the left is vented through outlet port 178 and into conduit 24. The fluid ports 174 and 176 remain closed when the valve member 30 is in the position of FIG. 3. The fluid in conduit 24 is conveyed to the control valve 20 where it enters the valve housing port 150 and exits the valve 20 through housing port 144. From port 144 the hydraulic fluid is returned through conduits 184 and 54 to the fluid reservoir.

As the rotary valve member 30 rotates through the first one half cycle of operation to the second one half cycle, the valve member 30 moves from the position illustrated in FIG. 3 to the position illustrated in FIG. 4. In the position of FIG. 4, the valve member 30 is operable to convey fluid under pressure to the water pump 12 to move the pump piston 198 to the right. To accomplish this, fluid under pressure is conveyed from the valve housing port 152 through conduit 26 to the pump housing inlet port 174. Simultaneously, fluid is vented from pump chamber portion 196 through outlet port 176 into conduit 28. Fluid in conduit 28 enters valve housing inlet port 156 and is directed by the rotary valve member 30 to the valve housing outlet port 148. From port 148 fluid is returned to the fluid reservoir through conduits 188 and 54.

Fluid under pressure entering valve housing port 174 and chamber portion 196 acts on the annular surface 276 to move piston 198 to the right. This movement of piston 198 forces water in chamber end portion 194 through the outlet port 212 and valve assembly 232 into conduit 220. The valve assembly 228 remains closed to prevent water from entering chamber end portion 194 from conduit 224. At the opposite end 200 of the pump piston 198, as the piston 198 moves to the right, the chamber end portion 192 fills with water. This is accomplished by opening of the valve assembly 226 to permit water to flow from conduit 222 through the inlet port 214. Valve assembly 230 remains closed as the chamber end portion 192 is filled to prevent water from entering the conduit 218.

Once the second half cycle of rotation of rotary valve member 20 is completed, the first half cycle of rotation is then repeated. The rotary valve member 30 then moves from the position of FIG. 4 back to the position of FIG. 3. Thus by operation of the rotary valve member 30 continuous reciprocation of the piston 198 is carried out to alternately pump water through the conduits 218 and 220.

As indicated above, the conduit 221 when used in water spraying operations in an underground mine is connected to a bank of nozzles where each nozzle has the same orifice size. By alternately conveying water through the conduits 218 and 220 a continuous spray is effected through the bank of nozzles. The spray pressure generated by the nozzles is dependent upon the orifice size of the nozzles. By changing the size of the nozzles the pressure of the spray can be varied. As for example, a nozzle having a 0.040 inch diameter generates a greater water spray nozzle pressure than a nozzle having a 0.060 inch diameter for the same flow rate through the conduits 218 and 220. Therefore, in order to obtain the pressure level of a 0.040 inch nozzle with a 0.060 inch nozzle, the volume of fluid entering the control valve 20 must be increased. This is accomplished by either closing valve 57 a selected degree or by closing valve 57 entirely and closing valve 62 a selected degree. In this manner the volume of fluid displaced by the timing device 32 is increased. The valves 57 and 62 are adjustable to control the volume of flow to control valve 20 up to the maximum capacity of pump 40 to supply fluid under pressure to the timing device 32.

Thus with the present invention, the pressure relief valve 62 and flow control valve 57 are operable to control the volume of fluid that is supplied to the chamber intermediate portion 196 of pump 12. The greater the volume of fluid under pressure conveyed through the housing inlet ports 172 and 174, the greater the longitudinal displacement or length of stroke of the piston 198. Thus if the pressure relief valve 62 is set to permit a given volume of fluid under pressure to flow to chamber 196 for a water spray pressure of 300 p.s.i. for example, and a reduction in pressure to 100 p.s.i. is desired, more fluid is diverted from the control valve 20 by opening the flow control valve 57 to a degree that reduces the volume flow to control valve 20 by an amount that decreases the spray pressure to 100 p.s.i.

Figure 5:
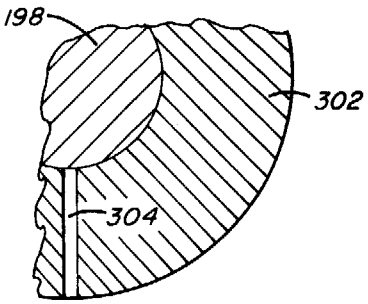
FIG. 5 is a fragmentary sectional view taken along lines V—V and V'—V' of FIG. 2, illustrating a passage in the pump housing for discharging fluid that has leaked past seals surrounding the piston in the pump housing.

Also in accordance with the present invention, the pump housing end portions 14 and 16 include flanges 320. Passageways 304, as illustrated in FIG. 5, extend through the flanges 302 from housing chamber 190 to the exterior surface of the flanges 302. As discussed above, annular sealing members 206 are retained in the pump housing 18 in sealing relation with pump piston 198. This arrangement provides a fluid tight seal around the piston 198 between chamber intermediate portion 196 and chamber end portions 192 and 194. However, in the event water from chamber end portions 192 and 194 leaks past the sealing members 206, the water will escape from the pump housing 18 through the passageways 304. Likewise should hydraulic fluid leak past the sealing member 206 from chamber intermediate portion 196, the escaped fluid will be directed through the passageways 304.

Further, in accordance with the present invention, the control valve 20 and the pressure relief valve 62 and the flow control valves 37 and 57 are operable to generate reciprocating movement of a piston in a device that is actuated by a reciprocating piston. Thus the control valve 20, together with the operator controllable valves 37, 57, and 62, are adaptable to reciprocate the piston of the rotary percussion drills disclosed in the patents incorporated herein by reference. By reciprocating the piston of the drill, percussive forces are imparted to the rotating drill rod. The rotating drill rod, in underground mining operations, drills holes in the mine roof for the installation of expansion-type roof bolts. Thus with the hydraulic system 10 the the present invention, the rotary valve 20 is operable to control the reciprocating movement of the piston. The rate at which percussive forces are imparted by the piston to the drill rod is controlled by the position of flow control valve 37 to control the rate of rotation of the timing gears 74 and 76. Further, the length of the stroke of the piston that imparts percussive forces to the drill rod is controlled by the position of the pressure relief valve 62 and the flow control valve 57 to control the volume fluid entering the rotary control valve 20 and acting upon the piston. The connection of the rotary control valve 20 to rotary percussion drill will be apparent to those skilled in the art and therefore will not be described herein in detail.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A control valve comprising, a unitary valve housing having a bore extending therethrough, a plurality of fluid inlet and outlet ports extending through said valve housing and communicating with said bore, a rotatable unitary valve member positioned in said bore, bearing means for rotatably supporting said unitary valve member in said bore, said unitary valve member having a plurality of inlet ports and a plurality of outlet ports, a plurality of internal passages in said unitary valve member for connecting in pairs said inlets with said outlets, timing means for rotating said unitary valve member at a preselected rate, said timing means being fluid actuated and including a pair of timing gears positioned in meshing relation in a fluid chamber with one of said timing gears being nonrotatably connected to said unitary valve member so that rotation of said meshing gears rotates said unitary valve member at a preselected rate, said fluid chamber having an inlet for receiving fluid under pressure from a source and an outlet for conveying fluid under pressure to said unitary valve member such that flow of fluid under pressure from said inlet through said fluid chamber to said outlet rotates said timing gears to rotate said unitary valve member and to convey fluid to said unitary valve member, said timing gears being rotatable by said fluid flow at a preselected rate to displace a preselected volume of fluid under pressure to control the volume of fluid being conveyed to said unitary valve member, a fluid circuit connecting said timing gears to a source of fluid and to said unitary valve member for controlling the flow of fluid from the source through said timing means to said unitary valve member, said fluid circuit including a pilot valve and an operator controllable valve means, said pilot valve being positioned in said fluid circuit between the fluid source and said timing means and operable to control the volume of fluid entering said timing means and thereby control the rate of rotation of said timing gears by normally diverting fluid away from said timing means and directing fluid flow from the source to a fluid reservoir, said operator controllable valve means being positioned in fluid communication with said pilot valve for actuating said pilot valve to direct fluid flow to said timing means and control the volume of fluid conveyed by said timing means to said unitary valve member, said unitary valve member being arranged upon each revolution thereof to rotate between a first valve position and a second valve position, a first set of said valve member inlet and outlet ports in said first valve position being positioned in communication with a first set of said valve housing inlet and outlet ports for directing a preselected volume of fluid upon rotation of said timing gears through said unitary valve member and said valve housing in a first flow pattern, and a second set of said valve member inlet and outlet ports in said second valve position being positioned in communication with a second set of said valve housing inlet and outlet ports for directing a preselected volume of fluid upon rotation of said timing gears through said unitary valve member and said valve housing in a second flow pattern.

2. A fluid actuated reciprocating system comprising, a piston housing having an internal chamber, said chamber having a first end portion and a second end portion, said first and second end portions each having an inlet and an outlet extending through said housing into said chamber, valve means positioned in said inlets and outlets for controlling the flow of fluid into and out of said chamber at each end portion thereof, a piston positioned in said chamber for reciprocal movement between said chamber first and second end portions, said piston including a first end portion and a second end portion positioned in spaced relation with said chamber first and second end portion respectively, a control valve including a rotatable unitary valve member for conveying fluid under pressure in a first direction during a first half cycle of rotation of said valve member and in a second direction during a second half cycle of rotation of said valve member and thereby alternately supply fluid under pressure through said chamber inlets to reciprocate said piston in said chamber and alternately displace fluid from said chamber end portions through said chamber outlets, timing means for rotating said unitary valve member at a preselected rate corresponding to a preselected rate of reciprocation of said piston, said timing means being fluid actuated and including a pair of timing gears positioned in meshing relation in a fluid chamber with one of said timing gears being nonrotatably connected to said unitary valve member so that rotation of said meshing gears rotates said unitary valve member at a preselected rate, a fluid circuit for controlling the flow of fluid under pressure from a source to said control valve, a pilot valve positioned in said fluid circuit between the source of said timing means, said pilot valve being operable to control the flow of fluid to said timing means by normally diverting fluid flow away from said timing means and directing fluid flow from the source to a fluid reservoir, operator controllable valve means arranged in fluid communication with said pilot valve for actuating said pilot valve to direct fluid flow to said timing means, and said operator controllable valve means being operable to actuate said pilot valve to move between a first position for directing fluid flow to the fluid reservoir and thereby interrupt fluid flow to said timing means and a second position for directing fluid flow to said timing means.

3. A fluid actuated reciprocating system as set forth in claim 2 which includes, conduit means for connecting said fluid chamber with said control valve to continuously convey pressurized fluid at a preselected rate and volume by rotation of said timing gears to said unitary valve member as the flow of pressurized fluid rotates said timing gears to rotate said unitary valve member, and said unitary valve member being operable to convey the pressurized fluid supplied thereto by rotation of said timing gears in said first and second directions for each revolution of said unitary valve member.

4. A fluid actuated reciprocating system as set forth in claim 2 which includes, a valve housing positioned around said unitary valve member, a plurality of fluid inlet and outlet ports extending through said valve housing, conduit means for connecting at least one of said valve housing fluid inlet ports with said fluid chamber of said timing means, said unitary valve member being arranged upon each revolution thereof to rotate between a first valve position and a second valve position, a first set of valve member inlet and outlet ports in said first valve position being positioned in communication with a first set of said valve housing inlet and outlet ports for directing fluid upon rotation of said timing gears through said conduit means to said unitary valve member and said valve housing in a first flow pattern, and a second set of valve member inlet and outlet ports in said second valve position being positioned in communication with a second set of said valve housing inlet and outlet ports for directing fluid upon rotation of said timing gears through said conduit means to said unitary valve member and said valve housing in a second flow pattern.

5. A fluid actuated reciprocating system as set forth in claim 2 which includes, said operator controllable valve means being positioned between the fluid reservoir and said pilot valve, said operator controllable valve means being normally operable to permit fluid flow through said pilot valve to the reservoir and by-pass said timing means, and said pilot valve being operable upon actuation of said operator controllable valve means to redirect fluid to said timing gears to control the volume of pressurized fluid displaced by rotation of said timing gears and conveyed to said unitary valve member to control the length of the stroke of said piston as said piston reciprocates in said pump housing chamber.

6. A fluid actuated reciprocating system as set forth in claim 2 which includes, said unitary valve member having a splined shaft end portion, said splined shaft end portion being nonrotatably connected to one of said pair of timing gears, and said pair of timing gears being rotated by fluid flow into said fluid chamber to rotate said splined shaft end portion and thereby transmit rotation to said unitary valve member and supply fluid under pressure to said unitary valve member.

* * * * *